US007681639B2

(12) United States Patent
Gardes

(10) Patent No.: US 7,681,639 B2
(45) Date of Patent: Mar. 23, 2010

(54) PROCESS TO INCREASE THE AREA OF MICROBIAL STIMULATION IN METHANE GAS RECOVERY IN A MULTI SEAM COAL BED/METHANE DEWATERING AND DEPRESSURIZING PRODUCTION SYSTEM THROUGH THE USE OF HORIZONTAL OR MULTILATERAL WELLS

(75) Inventor: Robert Gardes, Lafayette, LA (US)

(73) Assignee: Innovative Drilling Technologies LLC, Lafayette, LA (US)

( * ) Notice: Subject to any disclaimer, the term of this patent is extended or adjusted under 35 U.S.C. 154(b) by 0 days.

(21) Appl. No.: 12/140,484

(22) Filed: Jun. 17, 2008

(65) Prior Publication Data

US 2009/0308598 A1 Dec. 17, 2009

(51) Int. Cl.

| | |
|---|---|
| ***E21B 43/22*** | (2006.01) |
| *C12P 39/00* | (2006.01) |
| *C09K 8/58* | (2006.01) |

(52) U.S. Cl. ..... 166/246; 166/309; 166/371; 175/62

(58) Field of Classification Search ..... None
See application file for complete search history.

(56) References Cited

U.S. PATENT DOCUMENTS

| | | | | |
|---|---|---|---|---|
| 5,163,510 | A | 11/1992 | Sunde | |
| 5,669,444 | A | 9/1997 | Riese | |
| 6,543,535 | B2 | 4/2003 | Converse et al. | |
| 6,817,411 | B2 | 11/2004 | Mones | |
| 2004/0033557 | A1 * | 2/2004 | Scott et al. | 435/42 |

OTHER PUBLICATIONS

Budwill, Karen; Microbial Methanogenesis and its Role in Enhancing Coalbed Methane Recovery; article; Nov. 2003; pp. 41-46, CSEG Recorder, Focus Article; Alberta Research Counceil, Edmonton, Canada.

BudWill, Karen; Sustainable Coalbed Methane Production Microbial Regeneration of CBM Reservoirs and CO2 Conversion to Methane; Alberta Research Council; Carbon and Energy Management; 1 page.

* cited by examiner

*Primary Examiner*—Zakiya W. Bates
(74) *Attorney, Agent, or Firm*—Garvey, Smith, Nehrbass & North, L.L.C.; Gregory C. Smith

(57) ABSTRACT

A process to increase the area of microbial stimulation in a process of methane gas recovery in a multi seamed coal bed/methane dewatering and depressurizing production system by first utilizing an underbalanced multilateral drilling technique. At this point in the process one could introduce the microorganisms into the horizontal well bore to achieve a greater area of stimulation of the coal bed than would a vertical well. An even more preferred method would to first drill a series of lateral wells off of the horizontally drilled well bore, so as to increase or maximize the area of coal bed which is being covered. At that point, one would take the steps of what is known in the art of introducing a particular type of microorganism, which would then be injected via the plurality of lateral bores into the coal bed formation, to maximize the area of penetration, which would include, most, if not all, of the area of the coal bed through the series of lateral wells.

16 Claims, 13 Drawing Sheets

PROCESS TO INCREASE THE AREA OF MICROBIAL STIMULATION IN METHANE GAS RECOVERY IN A MULTI SEAM COAL BED/METHANE DEWATERING AND DEPRESSURIZING PRODUCTION SYSTEM THROUGH THE USE OF HORIZONTAL OR MULTILATERAL WELLS

CROSS-REFERENCE TO RELATED APPLICATIONS

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION 1. Field of the Invention

The process with present invention relates to downhole drilling in shales/coal seams. More particularly, the present invention relates to a process to increase the area of microbial stimulation in a methane gas recovery area in a multi seam coal bed/methane dewatering and depressurizing production system through the use of horizontal or multilateral wells in place of a plurality of vertical wells.

2. General Background of the Invention

It is being increasingly recognized in the industry in recent years that methane production can be obtained within shallow to very deep coal or shale beds within the earth's strata. Such an observation was deduced from studies of coal gases, changes in coal gas chemistry, and the bio-degraded nalcane pattern of some coal extract samples. In fact, the inventor in this application has developed a process utilizing underbalanced drilling into multiple coal and shale formations and dewatering the drill formations, which includes a process so that a lateral or horizontal borehole can be drilled within the coal seam, through a process which is covered in U.S. Pat. No. 6,923,275 and its related U.S. Pat. No. 6,457,540. In the patented process, the methane gas can be collected from multiple coal seams through the gas collection annulus and the water when collected where the methane gas is entrained, can be returned downhole for disposal and/or isolation.

What has become well known in the art, is that one can undertake a process for stimulating microbial activity in hydrocarbon-bearing subterranean formations. Such a process is found, for example, in U.S. Pat. No. 6,543,535 (the '535 patent) for stimulating the activity of microbial consortia in a subterranean formation to convert hydrocarbons to methane, which then can be produced, said patent which in its entirety is incorporated herein by reference thereto. One of such microorganism disclosed in the '535 patent is a methanogenic microorganism for example. The presence of microbial consortia is determined and a characterization made of at least one microorganism of the consortia, being a methanogenic microorganism. Therefore, by stimulating the coal/shale bed, the methane gas can be produced more readily, and it is then returned to the surface for collection in at least one of the processes as discussed above.

Currently, in the art of injecting microbes to stimulate a coal formation, of which applicant is aware, the only type of delivery system which is undertaken in the art, would be to drill a vertical well down into the formation, for example, as found in U.S. Pat. No. 6,817,411 and as discussed and found in U.S. Pat. No. 5,669,444. In the reading of the current state of the art, the vertical well is drilled to a depth within the coal seam, and at that point, the coal bed is stimulated with a consortia of microorganisms pumped into the formation and allowed to react with the coal/shale bed, and in turn enhance the production of methane within the confined area around where the vertical well is drilled. One of the short-comings in this particular current state of the art, is that usually a coal bed, although not necessarily thick, is spread over a wide area, and therefore, if one were to attempt to stimulate all of the coal bed through the use of a vertical well, it is foreseen that there would be a need for numerous vertical wells to be drilled into the subterranean coal formation in order to maximize the stimulation of the coal formation cleats. One can only surmise that the drilling of numerous vertical wells or directional wells from numerous well location pads, would be an extremely expensive and time-consuming undertaking and would not necessarily be a viable method of achieving maximum areal contact and sweep within the coal formation, in addition due to low injection pressures as to not exceed the fracture gradient in vertical wells it would be impossible to maintain constant reservoir pressure via inter-well bore connectivity. Therefore there is a need in the industry for a process which would enable one to enter the subterranean formation with non fluid invasive and contaminating drilling and completion techniques. A process to stimulate a vast area of the subterranean coal seams with a large areal contact with the cleat system of the coal formation. This can be performed at low injection pressures while maintaining an ecological environment that promotes the in-situ microbial degradation of hydrocarbons to methane gas.

BRIEF SUMMARY OF THE INVENTION

The process of the present invention solves the problems in the art in a simple and straightforward manner. What is provided is a process to increase the areal content and sweep efficiency with the ability to control an in-situ environment needed for microbial growth. This system of pressure communication between laterals, adjacent horizontal and or multi-lateral wells will allow for the formation environment to be maintained for maximum conversion of hydrocarbons to methane gas. Bottom hole pressures can be maintained over a large area for maximum desorption as well as modification of the area's environmental factors such as chemistry, temperature and salinity for proper microbial growth. The microbial stimulation system is a process of methane gas recovery in a multi seamed coal bed/methane dewatering and depressurizing production system by first utilizing an under balanced multilateral drilling technique, which includes the steps of drilling a first borehole into the coal or shale formation, setting casing and isolating the coal seams from other formations, lowering a carrier string with a deflection member down the first borehole to the level of the coal or shale formations, lowering a drill string into the carrier string to drill a horizontal borehole off of the first vertical borehole which would run along the length of the coal bed formation structure utilizing non invasive and formation contaminating fluids harmful to microbial action. At this point in the process one could introduce via injection the microorganisms into the horizontal well bore to achieve a greater area of stimulation of the coal bed than would be accomplished in a vertical well. An even more preferred method would to first drill a series of lateral wells off of the horizontally drilled well bore, so as to increase or maximize the area of coal bed which is being covered. At that point, one would take the steps of what is known in the art of introducing a particular type of microorganism, such as the type disclosed in the '535 patent, known in the art, which would then be injected via the plurality of lateral bores into the coal bed formation, to maximize the area of penetration, which would include, most, if not all, of the area of the coal bed through the series of lateral wells. After the microbes have been injected into the formation through the lateral wells, one would then undertake these further steps of completing the production steps involved in recovering any methane gas produced according to the process as disclosed in the invention. The methane gas produced would flow into the series of lateral boreholes through the annulus between the tubing and pump system and the cased well bore, where the produced water could be analyzed and treated for maintaining proper subsurface environment for microbial ecology.

Therefore, it is a principal object of the present invention to provide a process for increasing the area that microorganisms can be introduced into a subterranean coal bed beneath the earth, so as to maximize the area of the coal bed which is fed by the microorganisms in order to maximize the production of methane gas therein;

It is a further object of the present invention to provide the process for increasing the area of microbial introduction by utilizing a horizontal bore hole in the coal bed and introduce the microbes through the length of the horizontal well bore to reach a greater portion of the coal bed and allow the microbes to entrained into the coal bed for increased methane gas production in the process as disclosed.

It is a further object of the present invention to provide a process for utilizing a plurality of lateral boreholes off of the horizontal bore which would therefore allow a single vertical borehole to be drilled into the coal bed yet the horizontal and series of lateral bores would feed into the maximum portion of the coal bed and allow the microbes to entrained into the coal bed for maximum methane gas production in the process of the present invention.

It is a further object of the present invention to provide a process for utilizing a plurality of lateral boreholes off of a horizontal well to be in pressure communication with other horizontal and or multilateral wells to maintain the subsurface environments of chemistry, temperature, salinity and pressure so the environment conditions in the formation can be maintained for the maximum beneficial microorganism conditions.

It is a further object of the present invention to provide a process for utilizing a single stand alone injection well and a single stand alone completion well which do not need to be in communication with other injection and completion wells to carry out the process.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENT

Figure 1:
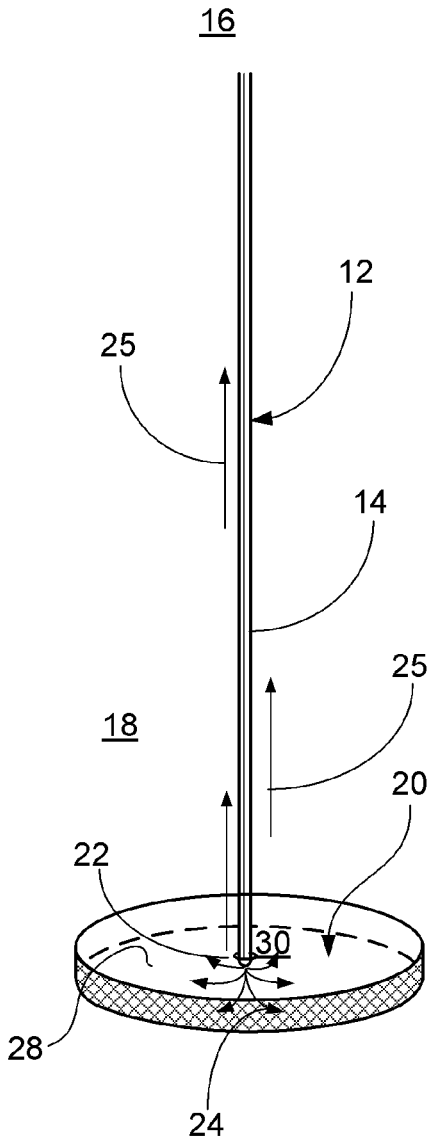
FIG. 1 PRIOR ART
FIGS. 1 and 1A illustrate in overall side view and isolated view respectively, a typical vertical borehole which is known in the art drilled into the level of each coal bed, illustrating the limited area of recovery therefrom.
Figure 1A:
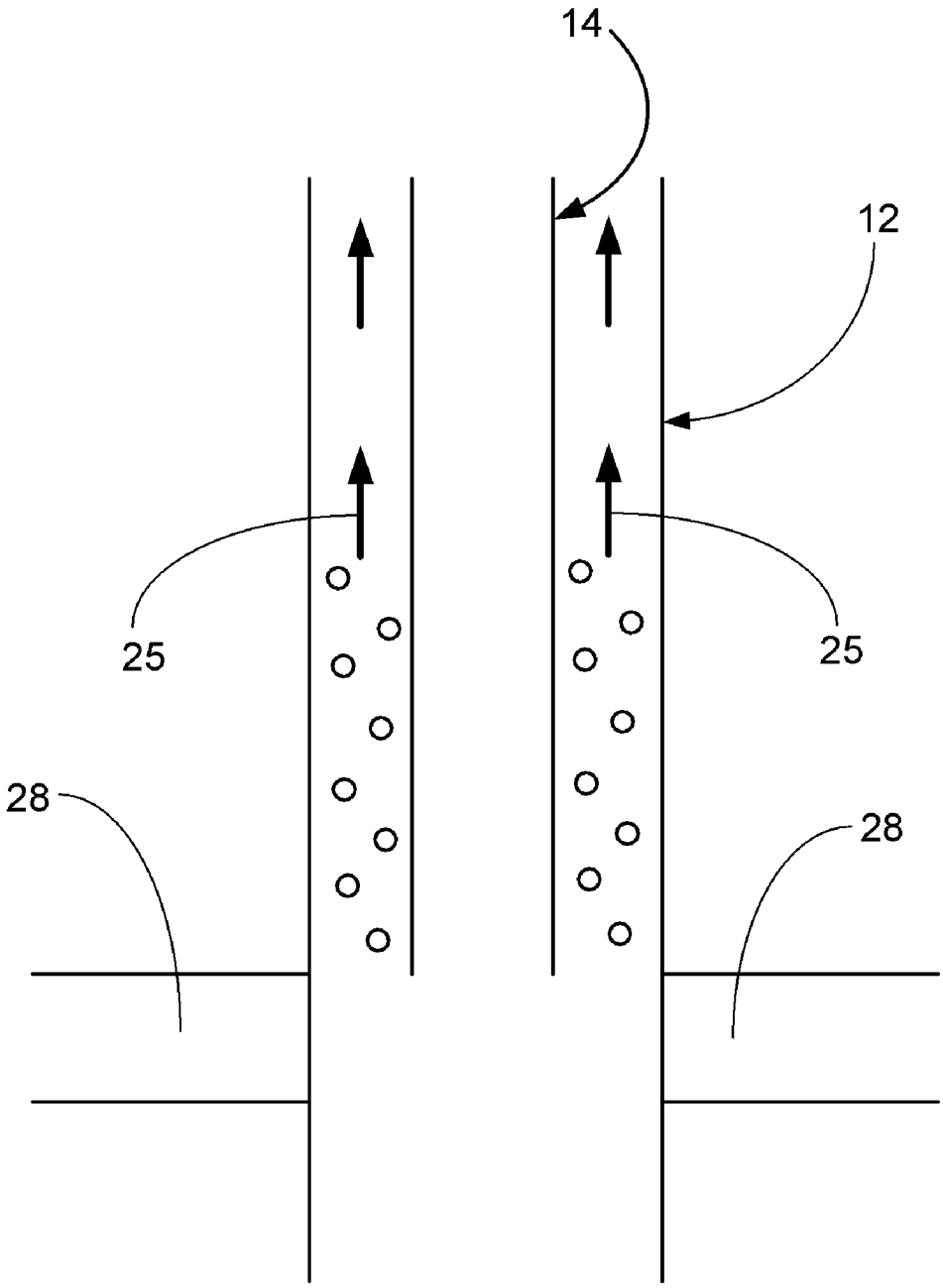
FIG. 1A PRIOR ART

FIGS. 2 through 13 illustrate the preferred embodiment of the method of the present invention, while FIGS. 1 and 1A illustrate the current state of the art in the stimulation of coal beds with microbes to stimulate the production of methane gas.

As seen in FIG. 1, there is a representation of a vertical borehole or well 12, having a vertically aligned vertical production string 14, extending from the surface 16 down through the earth 18 to reach the depth of a coal bed 20, which would be the type of bed which would be capable of producing methane gas. As illustrated in FIG. 1, the lower end 22 of the vertical string 14 would be lowered down to the precise depth of the coal bed 20, and upon reaching that depth, the consortia of microbes 24 would be released, through the end 22 of string 14 in order to penetrate the area or collection zone 28 around the lower end 22 of the vertical string 14 with microbes 24. As depicted in FIG. 1, the collection zone 28 into which the microbes 24 would be introduced is rather limited in size, numerous coal seams have low permeability and cleat structure and in many cases the coal seams are in close proximity to aquifers they cannot be stimulated with out breaching and communicating with the aquifers making it extremely difficult to have any large contact with the coal seam, since it is the area in the direct vicinity 30 of the end of the vertical string 14. This state of the art process as discussed earlier, is very limited in its ability to have maximum contact of microbes 24 into the coal bed 20. As illustrated in isolated view in FIG. 1A, as the well is produced, water 27 is either pumped up vertical string 14 after the coal has had time to soak with the microbial injection, allowing for desorption to take place; or gas is produced without pumping fluid up the vertical string 14, gas 25 would migrate up the annulus between string 14 and the vertically cased well bore 12.

Figure 2:
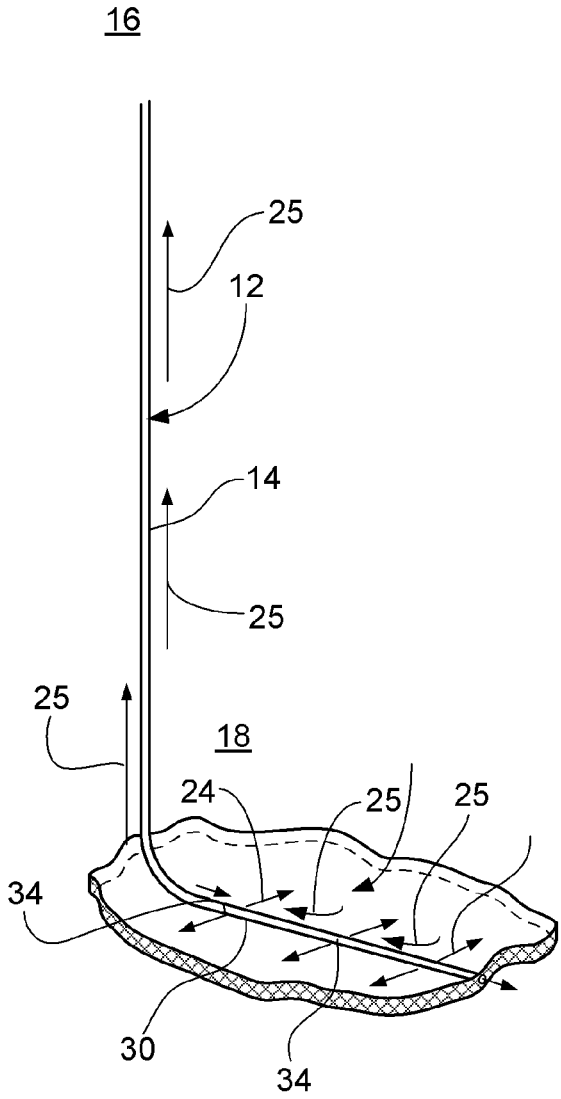
FIG. 2 illustrates the use of a single horizontal borehole for introducing microbes into the coal bed at that level which illustrates an increased area of penetration of the microbes into the coal bed.

Turning now to FIG. 2, there is depicted, as seen in FIG. 1, a representation of a vertical borehole 12, having a vertically aligned production string 14, extending from the surface 16 down through the earth 18 to reach the depth of a coal bed 20, which would be the type of bed which would be capable of producing methane gas. As was illustrated in FIG. 1, the lower end 22 of the vertical string 14 would be lowered down to the precise depth of the coal bed 20.

Figure 3:
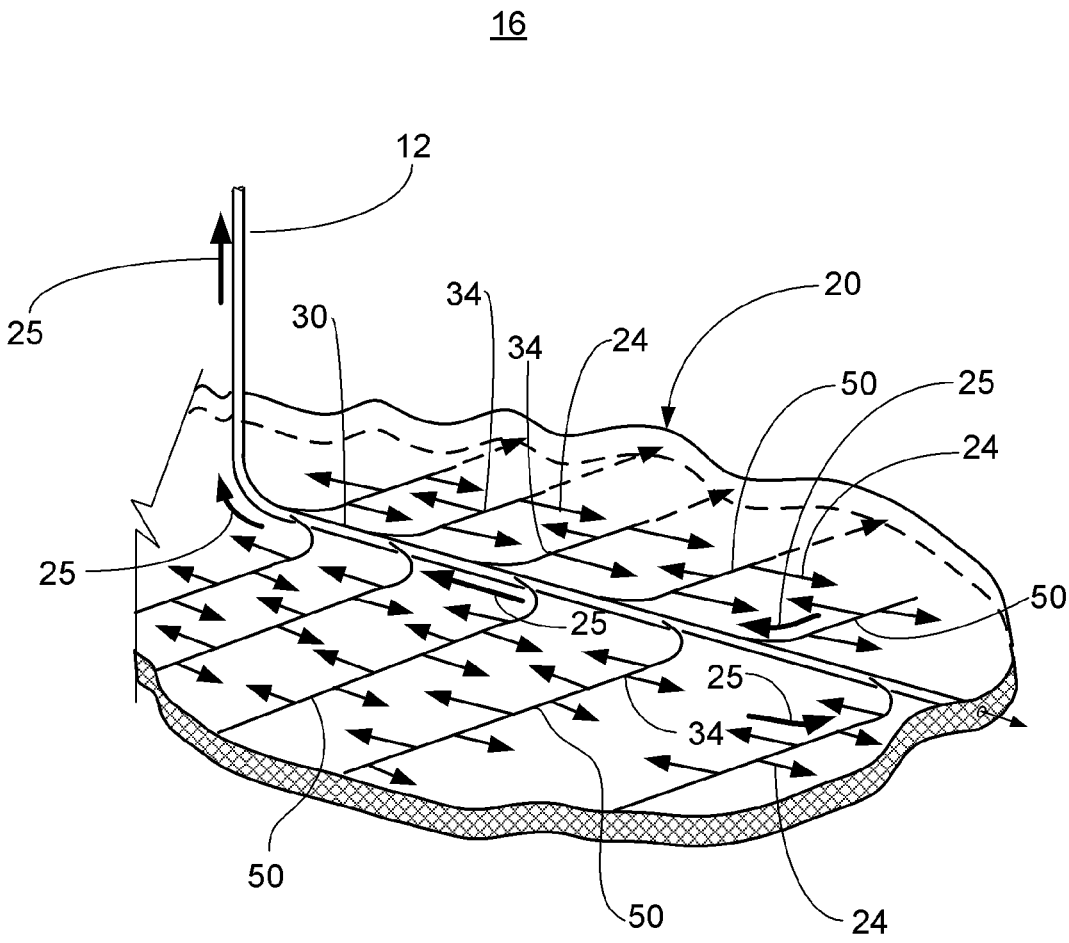
FIG. 3 illustrates a plurality of lateral boreholes drilled from the horizontal borehole into the coal bed, which would maximize the penetration of the microbes into the coal bed so as to achieve a maximum stimulation of the coal bed for maximizing the recovery of methane gas.

In the preferred embodiment, as discussed earlier, the process for undertaking the drilling of the wells as will be discussed in regard to FIGS. 2 and 3, is done so by the process of underbalanced drilling, referenced earlier. Since that process is a patented process of this inventor, its specific steps will not be discussed further.

Returning to FIG. 2, after the vertical borehole 12 has reached the coal bed 20, one would then drill a horizontal bore hole 30 from the vertical bore hole 12 at a depth within the coal bed 20, so that the horizontal bore hole 30 penetrates a distance through the coal bed 20, as predetermined by the production company. After the horizontal well 31 is complete, then the steps are taken to introduce the microbes 24 thru injection into the length of the horizontal bore hole 30, and allow the microbes to travel into the coal bed 20 through cleating in the coal matrix 34 throughout the length of the horizontal bore hole 30, so that the entire area along the horizontal path of the bore hole 30 is saturated with the microbes 24. This would then allow a much larger area of coal bed 20 to be stimulated by the microbes 24, which would in turn provide a much greater production of methane gas 25 to be returned and collected at the surface.

Reference is now made to FIG. 3, where there is illustrated the most productive method of increasing the area in which microbes 24 are introduced into a coal seam 20 in order to stimulate the production of methane gas 25. In this FIG. 3, following the completion of the horizontal bore hole 30, as discussed in regard to FIG. 2, the process would then entail drilling a plurality of lateral bore holes 50 directed out from the wall of the horizontal bore hole 30, each of the lateral bore holes 50 drilled at a similar depth and pressure communicated within the coal seam 20, as the horizontal bore hole 30, so as to provide an even larger area of coal bed 20 into which the microbes 24 can be introduced, as seen in FIG. 3. Again, following the drilling of the lateral bore holes 50, preferably in an underbalanced condition, as stated earlier, the microbes 24 are introduced into the coal bed 20 through cleating and fractures 34 in the wall of the lateral boreholes 50, and, in doing so, the maximum stimulation of the coal bed 20 is achieved, so that the maximum amount of methane gas 25 is returned to the surface 16 for collection.

Figure 4:
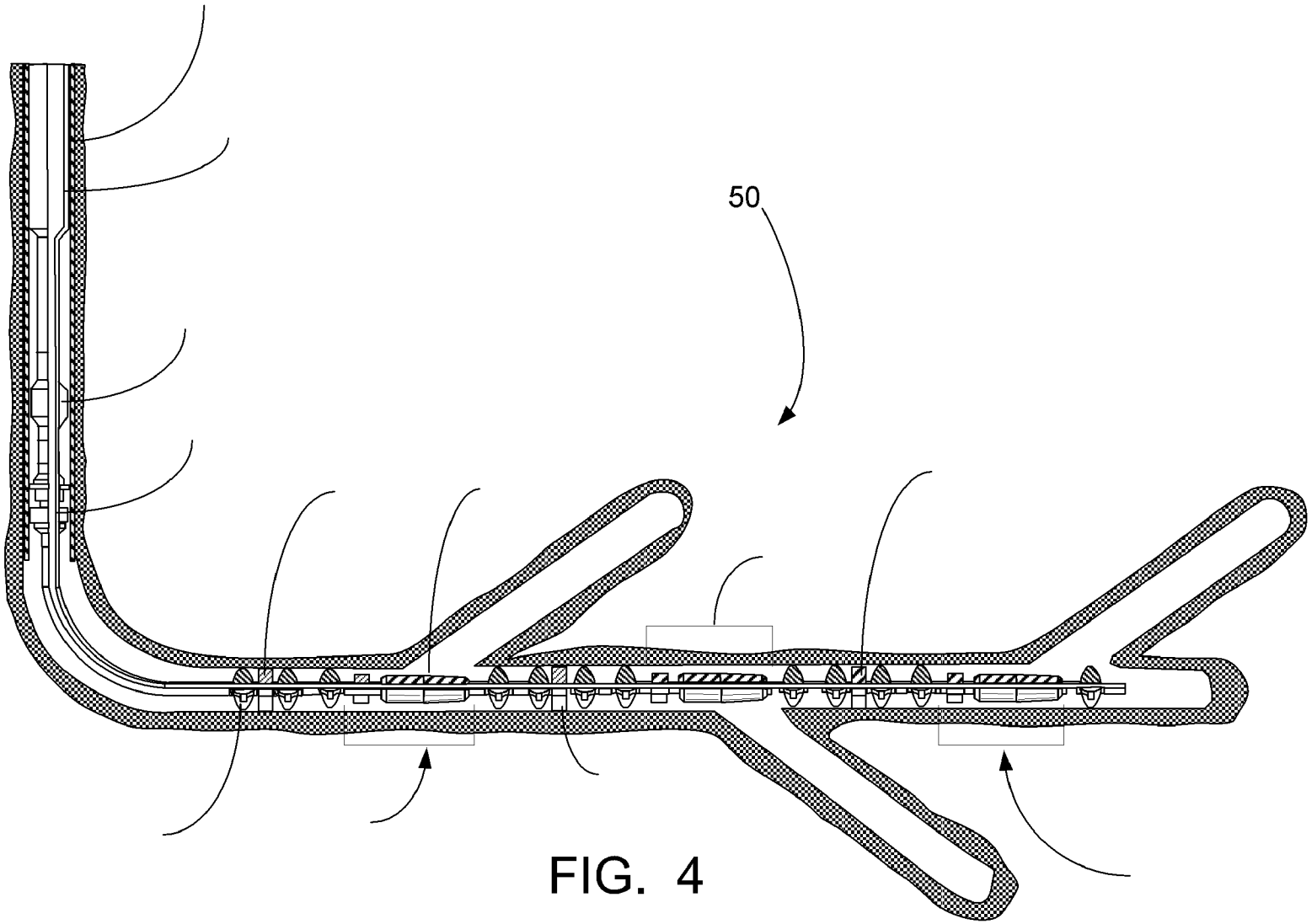
FIG. 4 illustrates a fractured horizontal well with unlined multilateral legs and the components utilized therein.
Figure 5:
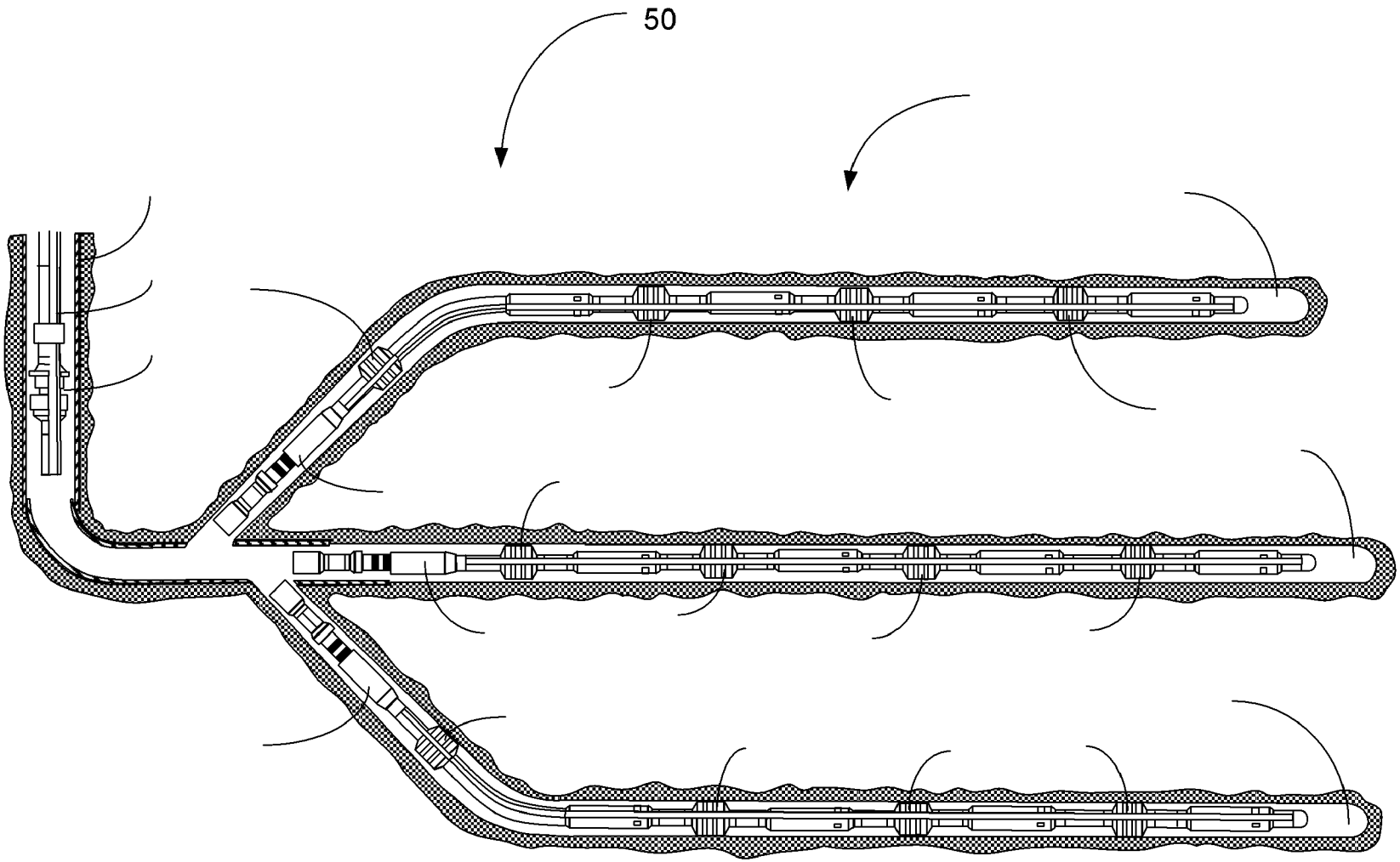
FIG. 5 illustrates a series of frac multi lateral wells.

FIGS. 4 and 5 are provided to provide a view of the typical fracturing technique for multiple laterals 50 which are utilized in the process of the present invention to achieve the maximum stimulation of the coal bed 20 with microbes 24 in an underbalanced drilling condition, as discussed earlier.

Figure 6:
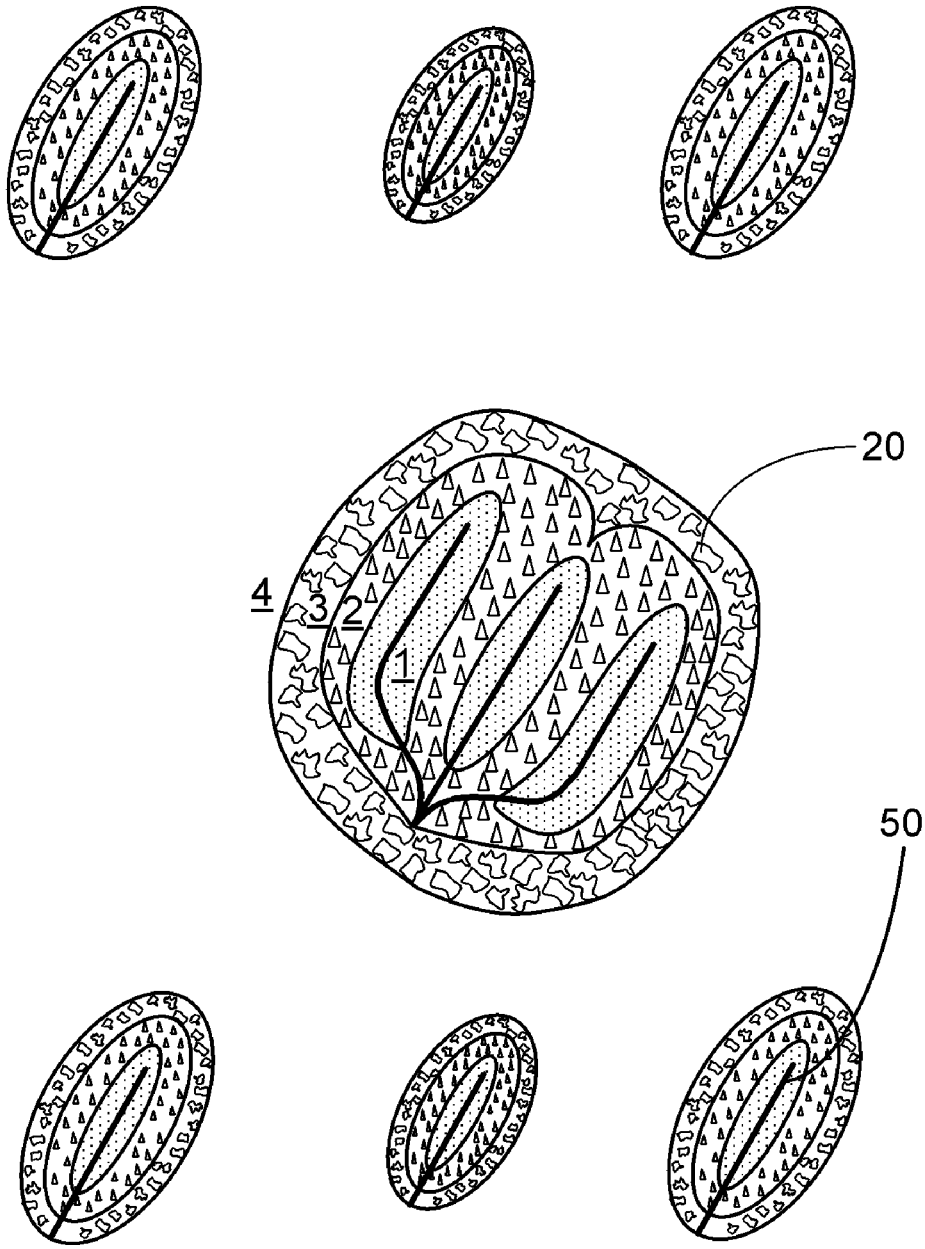
FIG. 6 illustrates areal communication surrounding horizontal well patterns compared to multilateral patterns of the present invention.
Figure 7:
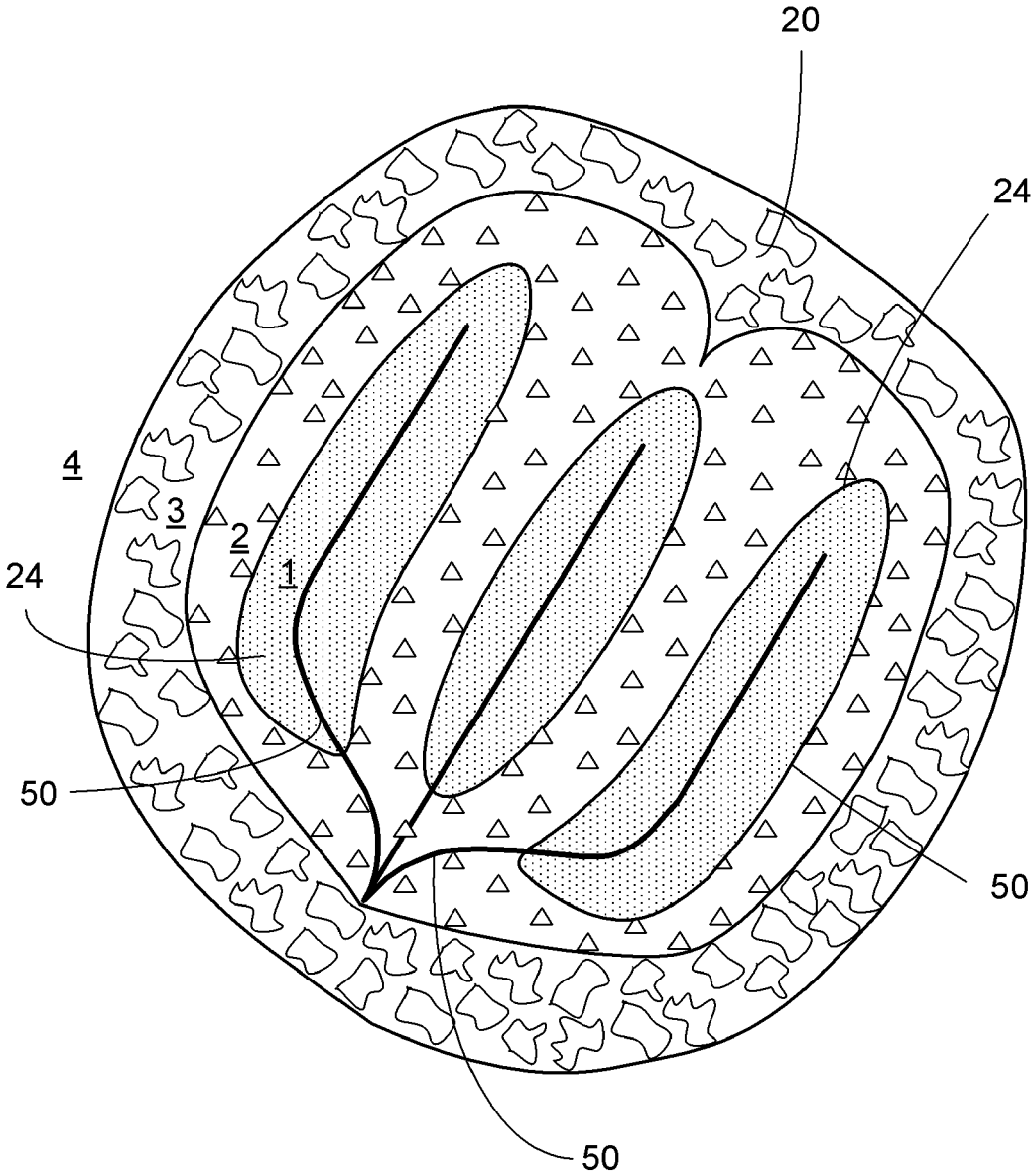
FIG. 7 illustrates a depiction of the large areal contact of the coal bed wherein microbes have been introduced through the use of multiple lateral wells.

FIGS. 6 and 7 illustrate representational views of the coal bed 20 wherein the microbes have been introduced through multi lateral wells 50 through the process of the present invention, and the increased area of coal bed 20 affected in the process for achieving maximum methane gas delivery.

Figure 8:
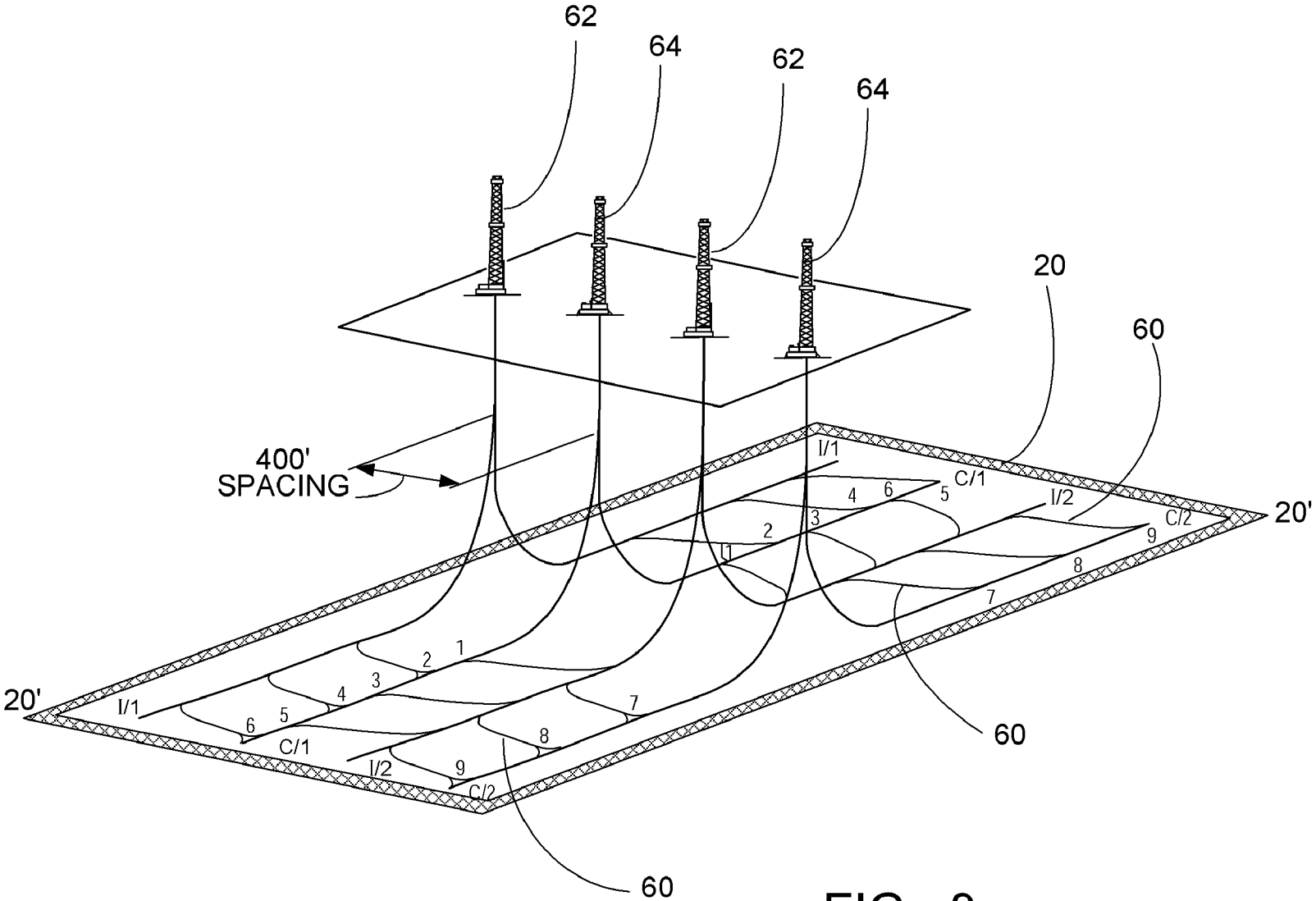
FIG. 8 illustrates a depiction of multilateral wells in pressure communication with other horizontal and or multilateral wells for maintaining proper ecological subterranean conditions for maximum microbial growth.

FIG. 8 illustrates a depiction of multilateral wells 60 in pressure communication with other horizontal and or multilateral wells 60 for maintaining proper ecological subterranean conditions for maximum microbial growth. As seen in the Figure, there are provided injection wells 62 for injecting the microbes into the coal bed 20 and collection wells 64 for recovering the gas from the stimulated formations into which the multilateral wells 60 are producing. The process would utilize a plurality of lateral boreholes 50 off of a horizontal well 31 to be in pressure communication with other horizontal and or multilateral wells to maintain the subsurface environments of chemistry, temperature, salinity and pressure so the environment conditions in the formation can be maintained for the maximum beneficial microorganism conditions. As illustrated there may be additional injection wells 62 and collection wells 64 as required to maintain the ecological condition for microbial activity.

Figure 9:
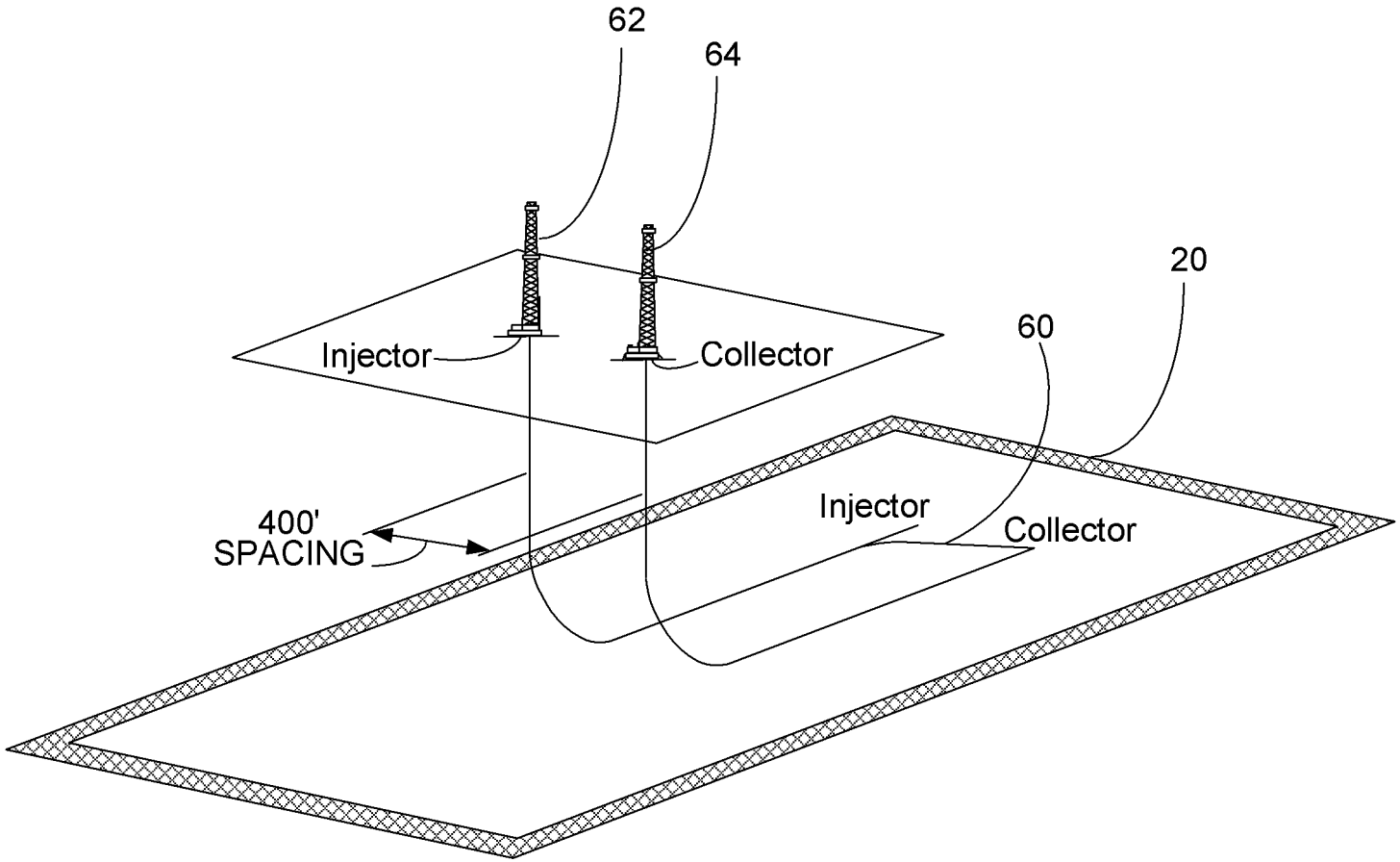
FIG. 9 illustrates parallel horizontal injector and collection wells in communication with each other.
Figure 10:
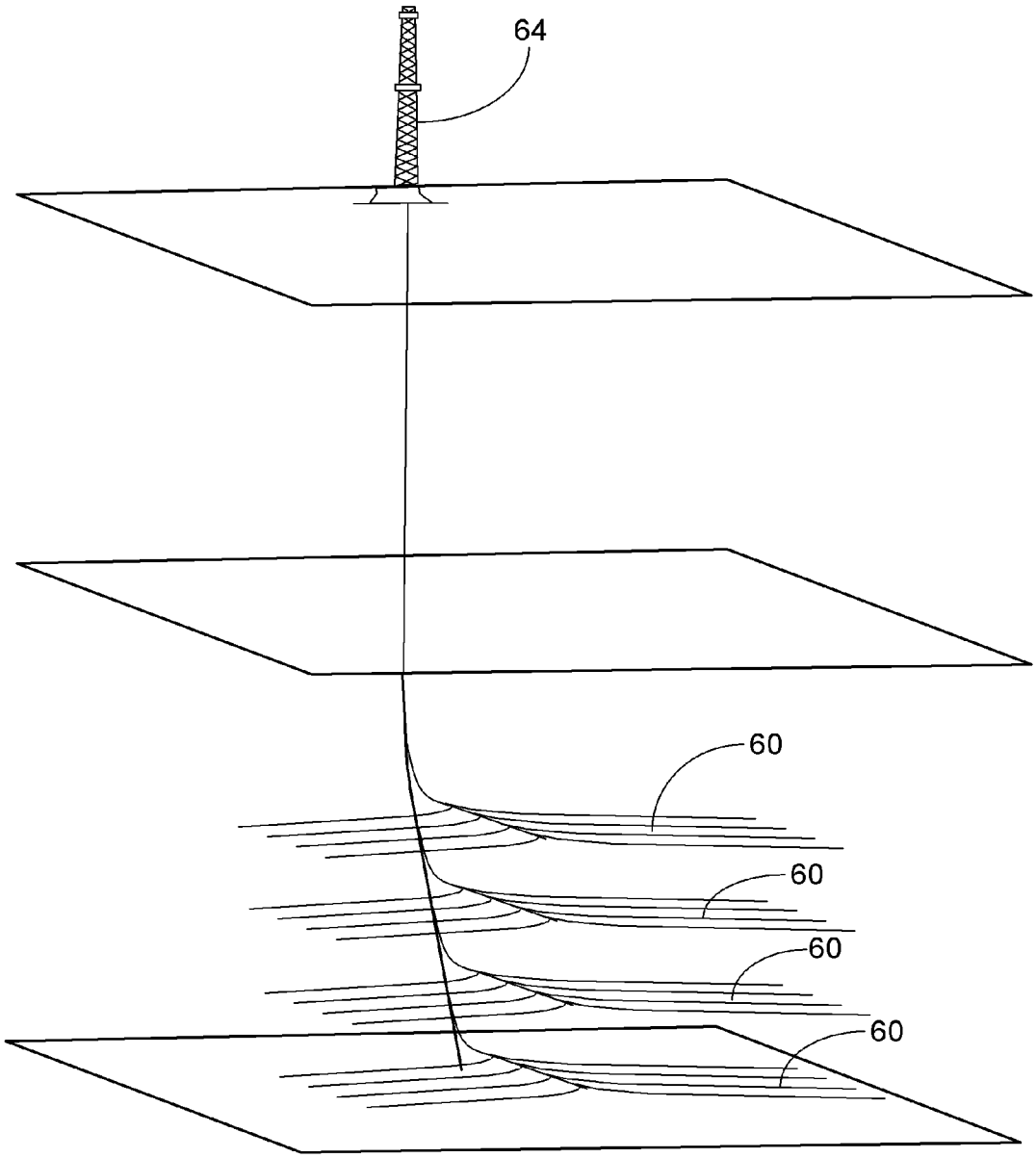
FIG. 10 illustrates a depiction of multiple lateral wells in multiple coal seams where microbial action can be introduced from a single well bore.

As illustrated in FIG. 9 there is provided an injection well 62 and a collection well 64 with pressure communication as described in FIG. 8. FIG. 10 provides a view of a collection well 64 with multiple seams and multi-lateral wells 60 in completion.

Figure 11:
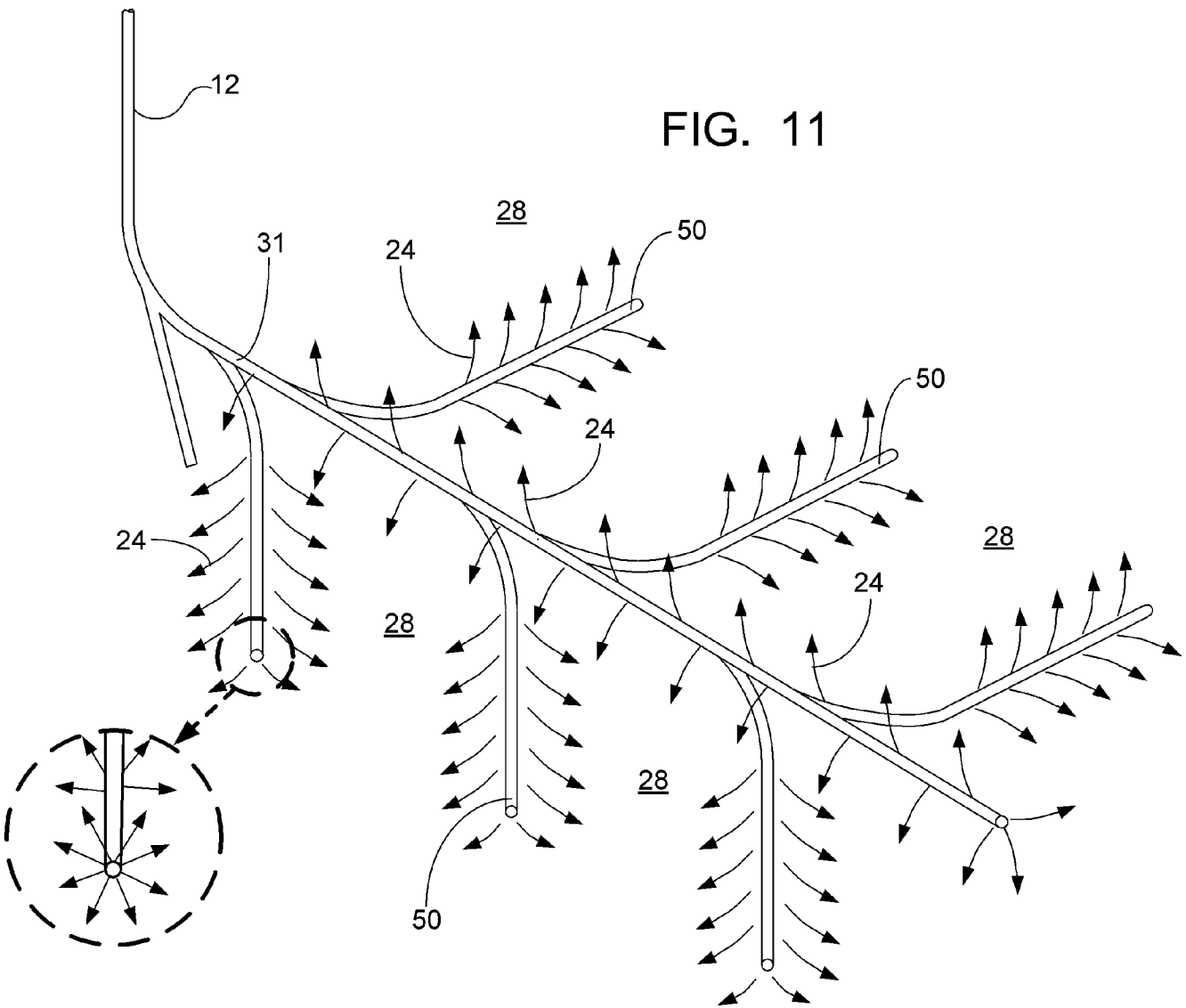
FIG. 11 illustrates a stand alone injection well used in the present invention.
Figure 12:
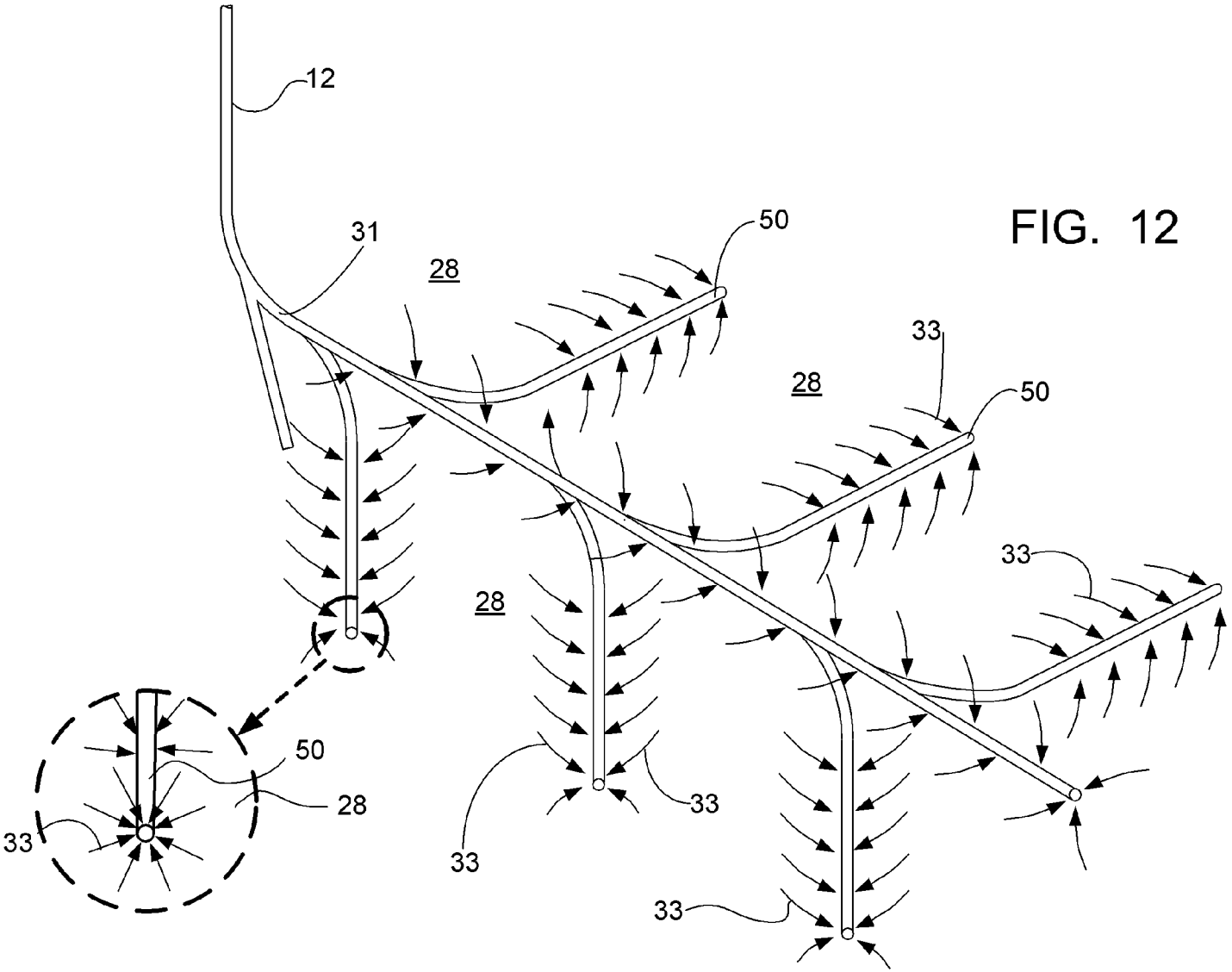
FIG. 12 illustrates a stand alone completion well used in the present invention.
Figure 13:
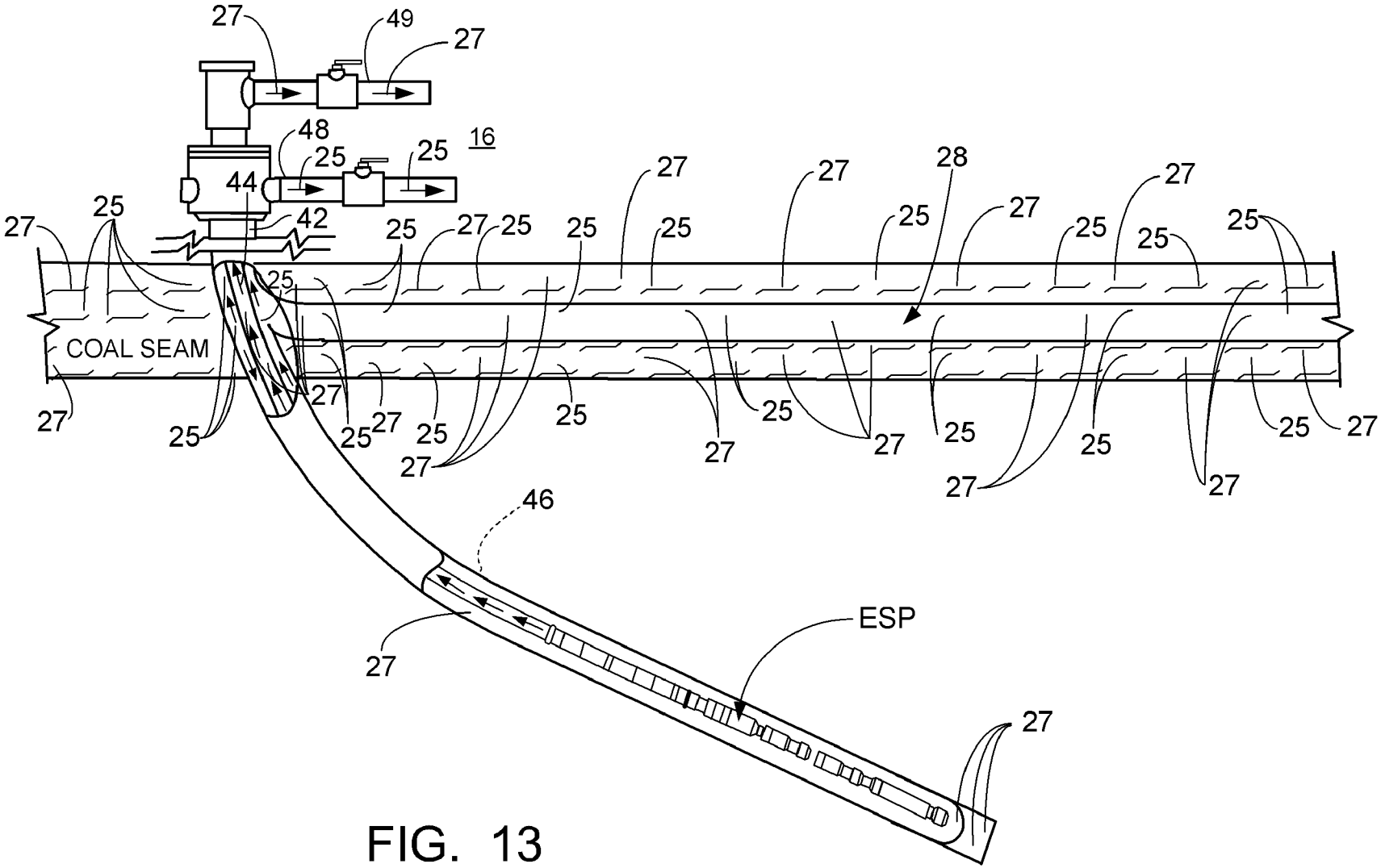
FIG. 13 illustrates a detail cutaway view of the stand alone completion well illustrated in FIG. 12.

FIGS. 11 through 13 illustrate a single stand alone vertical well 12 having the capability of serving both as an injection well 62 and a collection well 64 without the need to be in communication with any other wells. As seen in FIG. 11, there is a vertical well 12 drilled, and then there is a horizontal well 31 from which a plurality of multilateral boreholes 50 are drilled. Next, microbial fluid (arrows 24) is injected down the vertical well 12, into the horizontal well 31 and out of the various openings in the multilateral wells 60 and the horizontal well 31. Once that is done, and the collection zone 28 is stimulated with the microbes 24, FIGS. 12 and 13 illustrate a mixture 33 of methane gas 25 and water 27 entering the collection ports 26 into the collection zone 28 of the wells 31. This is illustrated in greater detail in FIG. 13, where the methane gas 25 is returned to surface 16 in an annulus 40 between the casing 42 and the tubing string 44, and the water 27 is returned up the inner bore 46 of the tubing string 44. The methane gas 25 is collected through line 48 at the surface 16, and the water 27 collected through line 49 at the surface 16. As stated earlier, in this embodiment, the well 12 does not have to be in communication with any other well 12, since it is a stand alone well. This type of well 12 could be designated as a "Huff and Puff" type program. Microbial fluid 24 is injected into the horizontal well 31 or injected into the multilateral wells 60 and then methane gas 25 could flow back into the pattern and be produced between the casing 42 and tubing string 44 as depicted in the completion drawing. Pressure maintenance can be maintained by fluid level in the substantially vertical well bore 12. This method offers diversity to the system by the process can be done with one well or a combination of wells in pressure communication with each other.

For clarity, the types of microbes could vary a great deal, but for purposes of the present process, the microbes used would be of the type disclosed in the '535 patent, noted above. The process depicted illustrates how fluid can be injected down injection wells and ecological conditions are maintained with fluid and gas extracted from collection wells.

PARTS LIST

| Part Number | Description |
|---|---|
| 12 | vertical borehole or well |
| 14 | vertical production string |
| 16 | surface |
| 18 | earth |
| 20 | coal bed |
| 22 | lower end |
| 24 | microbes |
| 24 | injection |
| 24 | arrows |
| 25 | gas |
| 27 | water |
| 28 | collection zone |
| 28 | producing zone |

-continued

PARTS LIST

| Part Number | Description |
|---|---|
| 30 | horizontal borehole |
| 31 | horizontal well |
| 33 | mixture |
| 34 | fractures |
| 37 | collection zone |
| 40 | annulus |
| 42 | casing |
| 44 | tubing string |
| 46 | inner bore |
| 50 | lateral borehole |
| 60 | multi-lateral wells |
| 62 | injection wells |
| 64 | collection wells |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A process to maximize the area of microbial stimulation of a coal bed to recover methane gas from a formation through a multiple well system, comprising the following steps:

a. drilling a first substantially vertical bore hole through the depths of seams in the coal bed;

b. drilling a horizontal well from the vertical bore hole at substantially the depth of the coal beds utilizing underbalanced drilling techniques as to leave the wellbore in in-situ and non invasive state and extending the well a distance to cover substantially a given length of the coal beds so that the well can serve as an injection well;

c. drilling the horizontal well with lateral extensions in a pattern substantially under formation pressure with produced water so as not to damage the permeability and cleat system of the coal seams;

d. removing the produced water for the horizontal pattern underbalanced and replacing the fluid with fluid containing nutrient enriched designer microbes so that substantially a maximum area of the coal seam permeability and cleat system is exposed to the fluid containing microbes;

e. drilling a second horizontal pattern underbalanced in close proximity to said first pattern as such to pressure communicate with said first pattern and allow the fluid from the first well to migrate in the subsurface through advection, dispersion and diffusion so that fluid will migrate from areas of higher pressure or concentrations to areas of lower pressure or concentrations;

f. wherein the chemistry of the drilling system will incorporate an anaerobic environment without oxygen present; and g. allowing the methane gas produced to flow up the well system so that the well serves as a collection well where methane gas can be collected from the collection well during underbalanced conditions and moved up the vertical bore hole to be collected and stored at the surface.

2. The process in claim 1, wherein the horizontal well being in pressure communication with other horizontal and/or lateral wells to maintain subsurface environments of chemistry, temperature, salinity and pressure so the environment conditions in the formation can be maintained for the maximum beneficial microorganism conditions.

3. The process in claim 1, wherein the underbalanced system includes the use of $CO_2$ or nitrogen.

4. The process in claim 1, wherein the process utilizes microbes including methanogenic microorganisms.

5. The process in claim 1, wherein area of coal bed which is stimulated by the microbes is substantially higher than the area stimulated by a vertical bore hole.

6. A process to increase the area of a seam of coal into which microbes can be introduced to stimulate the recovery of methane gas from the seam of coal, comprising the following steps:

a. drilling a first substantially vertical bore hole;

b. drilling a horizontal bore hole from the vertical bore hole at substantially the depth of the seam of coal;

c. extending the horizontal bore hole a distance to cover substantially the length of the seam of coal;

d. drilling the horizontal well with lateral extensions in a pattern substantially under formation pressure with produced water so as not to damage the permeability and cleat system of the coal seams;

e. removing the produced water for the horizontal pattern underbalanced and replacing the fluid with fluid containing nutrient enriched designer microbes so that substantially a maximum area of the coal seam permeability and cleat system is exposed to the fluid containing microbes;

f. drilling a second horizontal pattern underbalanced in close proximity to said first pattern as such to pressure communicate with said first pattern and allow the fluid from the first well to migrate in the subsurface through advection, dispersion and diffusion so that fluid will migrate from areas of higher pressure or concentrations to areas of lower pressure or concentrations;

g. wherein the chemistry of the drilling system will incorporate an anaerobic environment without oxygen present; and h. retrieving the methane gas from the horizontal bore hole during underbalanced conditions and moving the gas up the vertical bore hole to be collected and stored at the surface.

7. The process in claim 6, wherein the lateral bore holes are drilled substantially at the same depth as the horizontal bore hole within the coal bed.

8. The process in claim 6, wherein the microbes introduced into the coal bed include methanogenic microorganisms.

9. The process in claim 6, wherein the quantity of coal bed stimulated is substantially maximized through the use of the plurality of lateral bore holes.

10. A process to increase the area of microbial stimulation of a coal bed to recover methane gas, comprising the following steps:

a. drilling a first substantially vertical bore hole to the depth of the coal bed;

b. drilling a horizontal bore hole from the vertical bore hole at substantially the depth of the coal bed;

c. extending the horizontal bore hole a distance to cover substantially the length of the coal bed;

d. drilling the horizontal well with lateral extensions in a pattern substantially under formation pressure with produced water so as not to damage the permeability and cleat system of the coal seams;

e. removing the produced water for the horizontal pattern underbalanced and replacing the fluid with fluid containing nutrient enriched designer microbes so that substantially a maximum area of the coal seam permeability and cleat system is exposed to the fluid containing microbes;

f. drilling a second horizontal pattern underbalanced in close proximity to said first pattern as such to pressure communicate with said first pattern and allow the fluid from the first well to migrate in the subsurface through advection, dispersion and diffusion so that fluid will migrate from areas of higher pressure or concentrations to areas of lower pressure or concentrations; and g. retrieving the methane gas from the horizontal bore hole during underbalanced conditions and moving the gas up the vertical bore hole to be collected and stored at the surface.

11. The process in claim 10, wherein the lateral wells are drilled substantially at the same depth as the horizontal well within the coal bed.

12. The process in claim 10, wherein the microbes introduced into the coal bed include methanogenic microorganisms.

13. The process in claim 10, wherein the quantity of coal bed stimulated is substantially maximized through the use of the plurality of lateral wells.

14. A process to maximize the area of microbial stimulation of a coal bed to recover methane gas from a formation, comprising the following steps:

a. drilling a first substantially vertical bore hole to the depth of the coal bed;

b. drilling a horizontal bore hole from the vertical bore hole at substantially the depth of the coal bed;

c. extending the horizontal bore hole a distance to cover substantially the length of the coal bed;

d. drilling the horizontal well with lateral extensions in a pattern substantially under formation pressure with produced water so as not to damage the permeability and cleat system of the coal seams;

e. removing the produced water for the horizontal pattern underbalanced and replacing the fluid with fluid containing nutrient enriched designer microbes so that substantially a maximum area of the coal seam permeability and cleat system is exposed to the fluid containing microbes;

f. drilling a second horizontal pattern underbalanced in close proximity to said first pattern as such to pressure communicate with said first pattern and allow the fluid from the first well to migrate in the subsurface through advection, dispersion and diffusion so that fluid will migrate from areas of higher pressure or concentrations to areas of lower pressure or concentrations;

g. wherein the chemistry of the drilling system will incorporate an anaerobic environment without oxygen present; and h. retrieving the methane gas from the horizontal bore hole during underbalanced conditions and moving the gas up the vertical bore hole to be collected and stored at the surface.

15. An improved process to maximize the area of microbial stimulation of a coal bed to recover methane gas from a formation, comprising the steps of:

a. drilling a first substantially vertical bore hole to the depth of the coal bed;

b. drilling a horizontal bore hole from the vertical bore hole at substantially the depth of the coal bed;

c. extending the horizontal bore hole a distance to cover the length of the coal bed;

d. drilling the horizontal well with lateral extensions in a pattern substantially under formation pressure with produced water so as not to damage the permeability and cleat system of the coal seams;

e. removing the produced water for the horizontal pattern underbalanced and replacing the fluid with fluid containing nutrient enriched designer microbes so that substantially a maximum area of the coal seam permeability and cleat system is exposed to the fluid containing microbes;

f. drilling a second horizontal pattern underbalanced in close proximity to said first pattern as such to pressure communicate with said first pattern and allow the fluid from the first well to migrate in the subsurface through advection, dispersion and diffusion so that fluid will migrate from areas of higher pressure or concentrations to areas of lower pressure or concentrations;

g. wherein the chemistry of the drilling system will incorporate an anaerobic environment without oxygen present; and h. retrieving the methane gas from the horizontal bore hole during underbalanced conditions and moving the gas up the vertical bore hole to be collected and stored at the surface.

16. The process in claim 15, wherein the methane gas is collected at the surface and any water brought to the surface is collected through a different collection line than the methane gas.

* * * * *